US005860872A

United States Patent [19]

Vitale

[11] Patent Number: 5,860,872

[45] Date of Patent: Jan. 19, 1999

[54] BATTER'S STRIDE TRAINING DEVICE

[76] Inventor: Kevin Vitale, 19 Hickory La., Farmington, Conn. 06032

[21] Appl. No.: 612,091

[22] Filed: Mar. 7, 1996

[51] Int. Cl.[6] ..... A63B 69/36

[52] U.S. Cl. ..... 473/207; 119/819

[58] Field of Search ..... 273/26 R; 473/207, 473/212, 213, 217, 218, 266, 269, 270; 119/712, 816, 817, 819, 128, 726, 716, 856; 128/882, 879; 297/482; 241/16 PB

[56] References Cited

U.S. PATENT DOCUMENTS

| | | | |
|---|---|---|---|
| 914,059 | 3/1909 | Harris | 119/819 |
| 1,655,092 | 1/1928 | Davis | 473/212 |
| 2,450,162 | 9/1948 | Promen | 473/212 |
| 3,338,236 | 8/1967 | McLeod | 602/19 |
| 3,342,487 | 9/1967 | David . | |
| 3,350,096 | 10/1967 | Kile et al. . | |
| 3,423,094 | 1/1969 | Auslander | 473/207 |
| 3,815,906 | 6/1974 | Hermo . | |
| 3,979,116 | 9/1976 | Matchick . | |
| 4,088,326 | 5/1978 | Bibulco | 473/207 |
| 4,516,772 | 5/1985 | Stratton . | |
| 4,706,957 | 11/1987 | Jackson | 473/207 |
| 4,757,995 | 7/1988 | Gallagher . | |
| 5,005,833 | 4/1991 | Groveman | 473/213 |
| 5,016,885 | 5/1991 | Quigley . | |
| 5,116,306 | 5/1992 | Zander | 602/19 |
| 5,133,340 | 7/1992 | Koopmann | 602/19 |
| 5,186,698 | 2/1993 | Mason et al. . | |

FOREIGN PATENT DOCUMENTS

| | | | |
|---|---|---|---|
| 828721 | 5/1938 | France | 602/19 |

*Primary Examiner*—Theatrice Brown
*Attorney, Agent, or Firm*—McCormick, Paulding & Huber

[57] ABSTRACT

A training device for preventing a batter from overstriding and causing a batter to feel an attempt to overstride is disclosed. In one embodiment, the device includes a length of material, one-half of the length of which is approximately equal to a maximum desired stride length for a batter. The ends of the material are joined at a central location, so that the material forms a loop. A pair of adjustable sliding rings are provided along the material, and each adjustment member cooperates with a portion of material to form respective, separate ankle loops. The adjustment members are slid along the material toward the central location to define relatively large ankle loops through which a user may pass his or her feet, and thereafter, the adjustment members are slid toward the respective ankles to snugly fit around the user's ankles. The device is made of a resilient material which firmly yet gently prevents the batter from moving his or her front foot away from the rear foot by greater than the previous determined distance equal to the desired stride length.

17 Claims, 4 Drawing Sheets

BATTER'S STRIDE TRAINING DEVICE

BACKGROUND OF THE INVENTION

The present invention relates generally to baseball or softball training devices, and relates more specifically to a device worn on a batter's lower legs to promote proper stride during batting training and practice.

The present invention is engineered to promote awareness in a batter of the direction of his or her batting stride, both longitudinal and lateral, the prevention of an excessive length stride and the development of a consistent, proper length stride and balance through muscle memory. This simple, yet effective apparatus is worn on a batter's lower legs, slightly above the ankles, during batting drills where there are incoming pitches, or practices using tees or soft toss.

An excessive stride causes a series of problems for the batter. An excessive stride negatively affects a batter's balance, hip rotation, quickness, weight shift, timing and sight of an oncoming pitch. Any one or a combination of the above problems can lead to the batter having a slow bat, a poor eye or a lack of power.

The result of a slow bat is directly related to stride length. Since the swing cannot begin until a batter's front foot is planted on the ground, it naturally follows that the swing will begin sooner if the hitter's stride is shorter, that is, if the batter does not overstride. The shorter the stride, the quicker the bat. A shorter, more compact stride allows the batter extra time to get the bat head into position and to get the barrel of the bat through the hitting zone. If the batter is restricted from overstriding, the hips do not slide too far forward and waste valuable time, and the front foot makes contact at the proper point with the ground and immediately promotes weight shift, hip rotation and balance. This sequence causes a batter to get the bat head through the hitting zone.

A stable head permits a batter to see an oncoming ball in its real perspective. Quite often, overstriding results in "excessive" head movement, which means a change in the batter's line of sight and in turn impacts the batter's interpretation of the speed and direction of the approaching pitch. By eliminating the time it takes to plant the front foot when overstriding, the batter's head moves less and stops moving sooner, allowing additional time for the batter to see the ball in its true perspective.

Batters constantly wonder about their lack of power, when some pitches seem to jump off the bat, but others barely get to the outfield. Again, the solution begins with the batter's stride. The myth that a higher, longer stride generates power is not correct. Actually, little power is generated by the longer stride in comparison to rotation of the batter's body and extension of the arms. Rotation and extension generate superior bat head speed, which promotes power. Being in an overstriding position places the hitter's center of gravity and balance low and in the center of the stride similar to a first baseman, which restricts hip rotation. Thus, the overstride creates poor rotation, poor balance, and poor bat head speed for the batter. Having the proper length stride allows the hitter to easily shift his/her weight to the front foot, thus creating a center of gravity over the front foot to allow the hips to freely rotate and generate bat head speed and power.

Over the last several decades, baseball players, coaches, batting instructors and engineers have been devising different techniques and devices which promote a proper stance, prevent batters from stepping out of the batter's box and prevent overstriding. As a result, there are numerous known devices for teaching proper hitting techniques to a batter. One type of device utilizes a pair of cuff members, one each being affixed on the ankles of the player. The cuffs are coupled by an intermediate member such as a chain so that the batter cannot overstride. Such devices have a number of drawbacks. First, known chains are not resilient, and consequently upon overstriding a batter's ankles and front foot are jerked back unnaturally as the chain is extended to its full length. Specifically, the batter's front foot and toes are moved out of position by the jerking action. Because the toes on the front foot are used as a steering device for a batting swing, similar to a rudder being used as a steering device on a boat, numerous problems result from the toes being out of position.

For example, if a pitch is approaching the inside part of the plate, the ankle and toes on the front foot are rotated to point towards the pitcher. This simple movement allows the hips to rotate freely, quickly and naturally. The arms are extended and the hands now have ample room to pull the bat head into and through proper position, making contact with the ball out in front of the plate and on the sweet spot of the bat. Together, rotation and extension are the primary mechanism for bat head speed, which is directly responsible for the batter's power.

If the batter's ankle and toes are jerked back unnaturally towards their starting position on an inside pitch, i.e., perpendicular to a line between the batter and a pitcher, the batter's stride leaves the batter in a closed position, and the batter's hips cannot open freely and rotate as described above. Also, the arms do not have ample room to pull the bat head into proper position, out in front of the plate. Consequently, the batter makes contact on the inside part of the bat, nearer the hands and away from the bat's sweet spot, and the batter gets "jammed" and hits the ball weakly.

The great hitters of baseball always refer to hitting as a science. To understand and master the science of hitting, the great hitters have expressed the need for a batter to have a superior ability to concentrate and stay focused. Before a batter steps into the batter's box, he must know such things as the count, and each time he steps up to the plate, the number of outs in the inning, if there are runners on base, if their team is ahead or behind in the game, the inning of the game and the opposing pitcher's tendencies and best pitch. All of this is important in order for the batter to have a good idea of the type of next pitch.

Once he steps into the box, the batter needs to stay focused and concentrate only on the rotation of the laces of the oncoming pitch. The rotation of the laces shows the batter the direction and the speed at which the ball is moving. If a batter is thinking of the situation or the mechanics of the swing, these distractions will lead to his/her failure to hit the ball with any consistency.

Distractions to a batter who is trying to concentrate on an oncoming pitch can come in many forms. In devices including metal chains, the chains are unnaturally heavy, especially for the smaller or younger batters, and distracts a batter from his concentration on an oncoming ball. This results from the extra weight felt around the batter's legs, which requires extra energy to lift the front leg and stride, compared to normal. Devices which employ chains, even plastic chains, are also noisy, and the noise generated during a swing further distracts the batter from focusing on the oncoming ball. This is true to most sports where a swinging motion is required, such as golf or tennis. As discussed above, it is critical for a batter to stay completely focused in order to be successful consistently at the plate.

Some of the above mentioned devices are designed for use by batters of all various heights, and therefore adjustable to various stride lengths. These adjustments and needed assembly are both time consuming and especially complicated for youth players. For example, in prior art devices a batter first needs to wrap and affix each cuff member to a leg, and then attach an elongated restraining device to both cuff members. The elongated device is fabricated from a plurality of links (metal or plastic), and have one or more removable links positioned at both ends which attach to the cuff members. Before the player fastens the device to the front leg, he must step up to the plate, get into a comfortable stance, spread the restraining device along the direct path between the ankles of the player and add some desired distance, for example six to eight inches, beyond the stance. At that particular point, the batter fastens the restraining device to the front leg. The excess amount in the restraining device is then placed out of the way by connecting it with another link towards the back foot.

The above-described assembly poses additional problems by assuming a player's comfortable stance is the same as their proper stance, and that a player or coach knows a proper stance for a particular batter. A proper length stance is generally assumed to be the width of the batter's shoulders, and a batter who is comfortable taking a wider stance will be overstriding if an extra six to eight inches, are added to the length of the restraining device. Also, a youth does not take as long a stride as an adult. A youth should generally take a stride 2" to 4" wider than his shoulders, while an adult of 72" or more would more likely take a stride that is 6" to 8" wider than his shoulders.

Still another problem faced by shorter players is the excess chain or other material which remains free after adjustment. This material can be tripped upon, even if the excess material is attached upon itself, since it will still extend to the ground for the shortest players. Moreover, known devices which provide for adjustment of the stride length tend to separate, break or slip to such that the permitted stride length varies during use, which does not promote a consistent, proper stride.

Other types of devices for establishing a proper stance and limiting a batter's stride are shown in U.S. Pat. Nos. 4,516,772 to Stratton, 3,815,906 to Hermo, 3,342,487 to David, 3,350,096 to Kile and 3,979,116 to Matchick, and either lay on or are fixed to the ground. A batter stands at and positions his or her feet relative to the device, and a pair of stops is positioned so that the batter knows where to position his feet. A batter's front foot is movable from the rear foot, and forward towards an oncoming ball, but not forward beyond a predetermined point. Some devices of this type only permit a batter to move the front foot parallel, but not laterally, to the oncoming ball.

These devices have an number of drawbacks. For example, such devices are rather complicated, cumbersome and include associated expense and time to assemble and properly set up. As noted above, such devices may not permit a batter to step laterally with respect to an oncoming ball, and thus are of limited effectiveness in teaching a batter to step inside with the front foot to hit an outside pitch, or outside to hit an inside pitch. Such devices can also present a safety hazard since they may not permit a batter to step out of the way of an oncoming ball which may otherwise hit the batter. Certain types of these devices are also not readily adapted for use by right handed and left handed batters.

Therefore, it is an object of the present invention to provide an apparatus which can be used by baseball and softball players during batting practices, drills and training which promotes awareness to the direction of a batter's stride and balance, through feeling. It is important for the batter to be able to step in the correct direction for an oncoming pitch, whether the pitch is inside, outside or down the middle.

It is another object of the present invention to provide prevention of an excessive length stride and to develop consistency of the proper length stride through muscle memory.

It is another object of the present invention to be inexpensive and affordable by any one individual player.

It is another object of the present invention not to require assembly, and to provide an effective device that is readily portable. For example, the devices, of the present invention will fit in a user's pants pocket.

It is another object of the present invention to come in predetermined sizes for youth and adult players which would require little or no adjustments in determining stride length.

It is another object to provide a device fabricated from a tubular material to prevent abrasions resulting from continued use.

It is another object of the present invention to be extremely light weight, comfortable and unnoticeable when wearing the device in order for the batter to feel totally natural when standing at the plate, allowing him or her total concentration on the incoming pitch.

SUMMARY OF THE INVENTION

In accordance with the present invention, a batter's training device is disclosed which is worn by a batter to prevent a batter from overstriding during a batting swing and causes the batter to feel a negative movement upon attempt to overstride.

The device includes at least one loop of a length of flexible, resilient material, which extends around, and preferably defines a loop around, and between a batter's lower legs. The material has a cross section which defines a relaxed diameter, e.g., thickness. The loop has a maximum diameter that is approximately equal to a desired stride length.

A pair of adjustment rings are provided, and are slidably received on the length of material. Each of the rings defines at least one through bore that is smaller than the relaxed diameter of the material, and the length of material passes through each ring at least twice, so that the rings cooperate with respective portions of the length of material to form a pair of adjustable ankle loops. The rings are slidable along the material in order to adjust the size of each ankle loop between a first size that is large enough for a batter to insert his or her feet through the ankle loops, and a second size that is slightly larger than a circumference of a batter's lower leg so that the device is snugly fitted to the batter's ankles. The device may also include a third, central adjustment ring through which the length of material passes, to provide selective adjustment of the permitted stride length. Excess material is tied off or cut.

One advantage of the present invention is that the device prevents a batter from overstriding in a firm manner, but without causing any abrupt movement of the batter's front foot. The device lets a batter feel the negative movement associated with attempts to overstride. The device is inexpensive, and lightweight for easy portability, and for example, fits in a pant's pocket.

Another advantage is that the present invention is light and quiet while effectively preventing a batter from overstriding, so that the device does not distract a batter from concentrating on an oncoming ball.

Still another advantage is that the present invention is readily worn and removed by a batter without requiring assembly or disassembly, and is easily used by a right-handed or a left-handed batter.

Yet another advantage of the present invention is that there is no excess material between a batter's feet, so a batter cannot trip on excess material.

A further advantage of the present invention is that a batter can step laterally with respect to an oncoming ball, and can therefore practice a proper stride whether the ball is nearer to the batter, i.e., for an inside pitch, or farther away from the batter, i.e., an outside pitch. The device exaggerates the effect of stepping inappropriately into or away from an oncoming ball. Moreover, the present invention permits a batter to step away from an oncoming ball which would otherwise hit the batter, and therefore provides an added measure of safety.

DETAILED DESCRIPTION OF THE PREFERRED EMBODIMENTS

Figure 1:
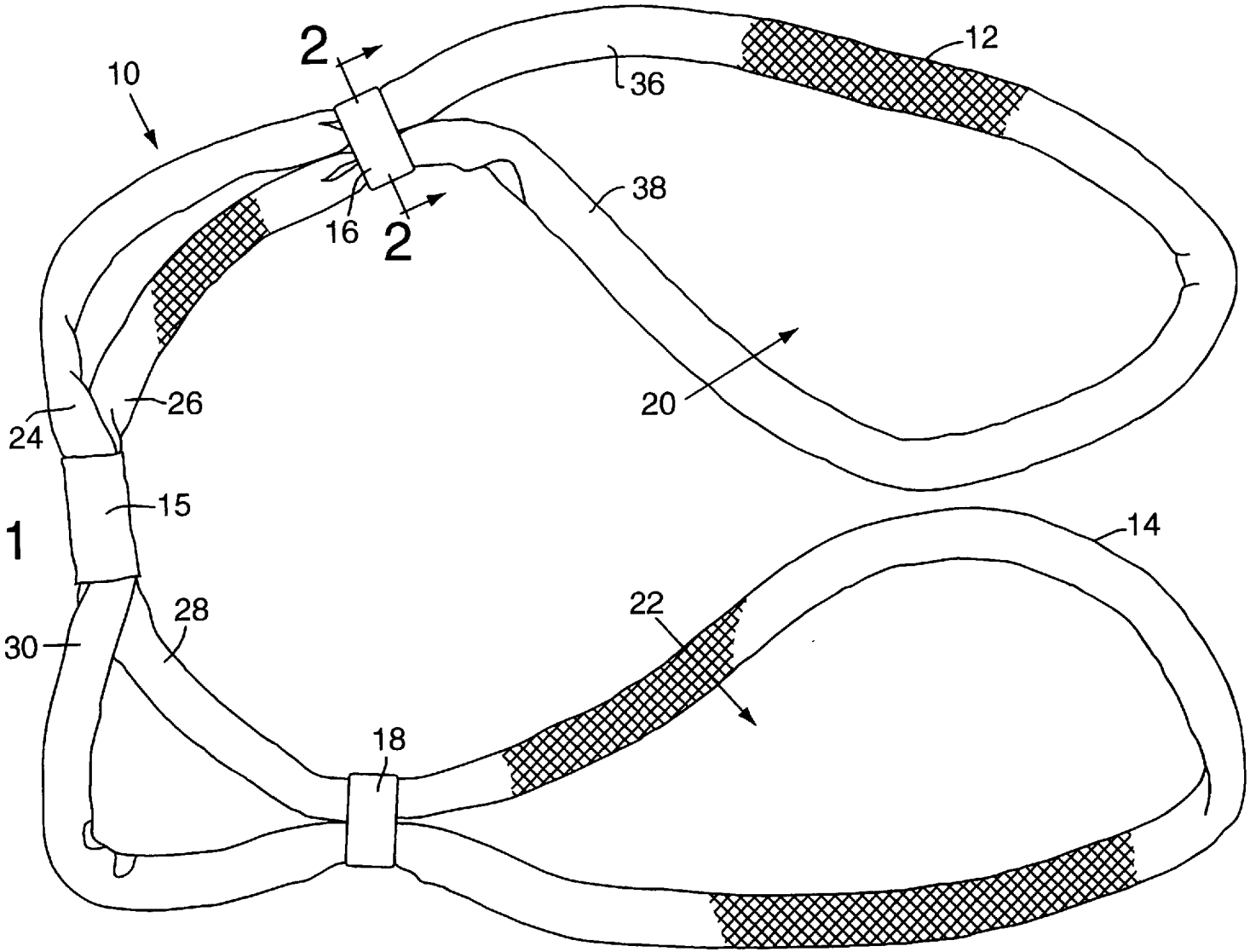
FIG. 1 is a schematic view of a batter's training device in accordance with the present invention.

Turning now to FIG. 1, there is illustrated a device 10 in accordance with the present invention. The device 10 includes first 12 and second 14, lengths of resilient, flexible material, which are joined to one another at a central joining member 15 as further described below, and also includes a pair of adjustment members referred to herein as "rings" 16, 18. As used herein, the term "rings" is not limited to disc-shaped rings, but rather is intended to include various other sizes and shapes. The straps 12,14 and respective slides 16,18 cooperate to define adjustable first 20 and second 22 ankle loops.

Each length of material 12, 14 has opposite ends, 24,26 and 28,30, and as illustrated in FIG. 1, the ends are connected to the joining member 15 in a conventional manner, e.g., by sewing, although a length of material which forms a seamless loop may be employed with equal effect. In the embodiment illustrated in FIGS. 1 and 2, the respective ends 24,26 and 28,30 of each length of material are joined to one another and also joined to the joining member 15. The material is preferably a two-ply, knit cotton tube with plies 25, 27 shown in FIG. 2, and has a relaxed diameter of approximately one-half inch, although other sizes and types with the inner ply being twisted about its length of material, e.g., elastomeric material, may be employed with equal or similar effect. In addition, the material is somewhat resilient, e.g., the material stretches to about 110% of its original length, so that as a batter strides during a swing and reaches the end of his or her desired stride length, e.g., about 2–6 inches wider than the batter's shoulder width, the material exerts a firm-pull on the batter's front leg, thereby causing the batter to plant his or her front foot at an appropriate distance from the rear foot. The resiliency of the material such as cotton permits the device to stretch slightly, and thereby absorb the shock that would be felt in a batter's legs if the material were not resilient. The joining member 15 is preferably made of a 100% satin material, but other materials including non-fabric materials may be employed with equal effect. Without regard to the material used for the lengths of material 12,14 and the joining member 15, the material may be of various colors.

Figure 2:
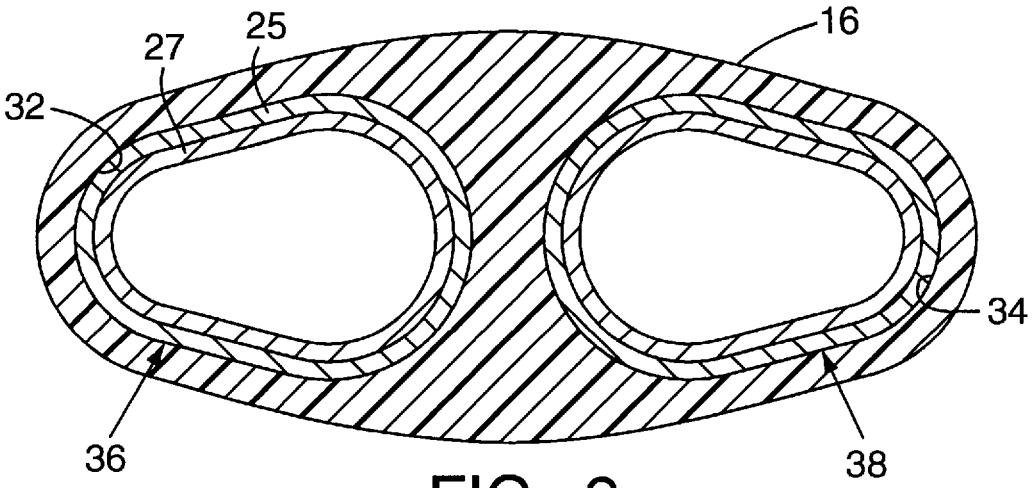
FIG. 2 is a sectional view of the device of FIG. 1 taken along line 2—2, illustrating the relationship between an adjustment ring and material of the device.

The adjustment rings 16,18 are preferably of identical construction, and with reference to FIG. 2, each ring 16 defines a pair of similarly-shaped through bores, 32,34 each of which has a cross section that is smaller than the relaxed diameter of the length of material. The ring 16 is preferably made of a tough, durable material to resist breakage, e.g., where the batter attempts to overstride forcefully or where the ring is stepped on, and in the illustrated embodiment is made from an elastomeric material such as grip cloth. The ring material is also selected to grip the lengths of material using friction. Portions 36,38 of the length of material pass through the ring, so that the material passes through the ring 16 at least two times. By employing a bore size that is somewhat smaller than the relaxed diameter of the material, the ring is slidable relative to the material, but maintains its position relative to the material unless manually manipulated. The double bore ring 16 is advantageous in that it is retained on the straps, and thus cannot become lost.

Figure 3:
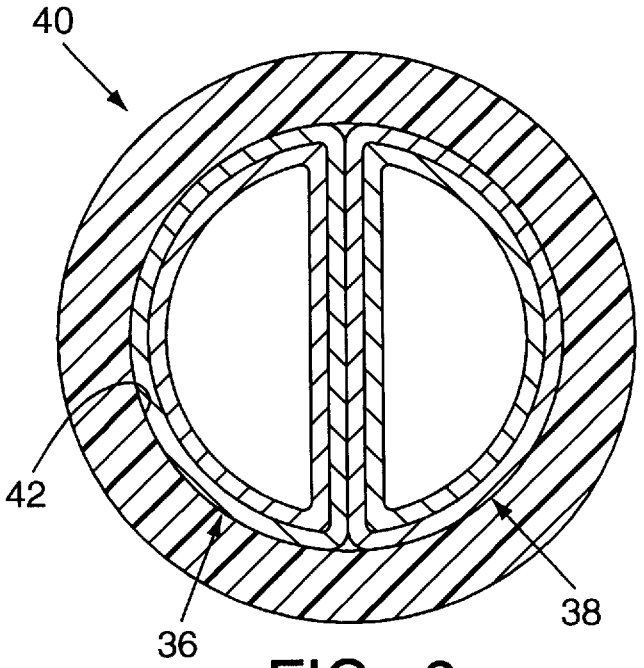
FIG. 3 is a view similar to FIG. 2, but illustrating a second embodiment of the adjustment ring.

FIG. 3 shows an alternate embodiment of the ring indicated generally at 40. The alternate ring 40 includes a single through bore 42 which has a combined cross-section that is smaller than a cross-section of the two-portions 36,38 of the strap, so that the material must be slightly compressed in order to pass through the ring 40. The single bore embodiment of the ring is advantageous in that if a ring breaks, the device need not be disassembled to install a new ring on the length of material.

Figure 4:
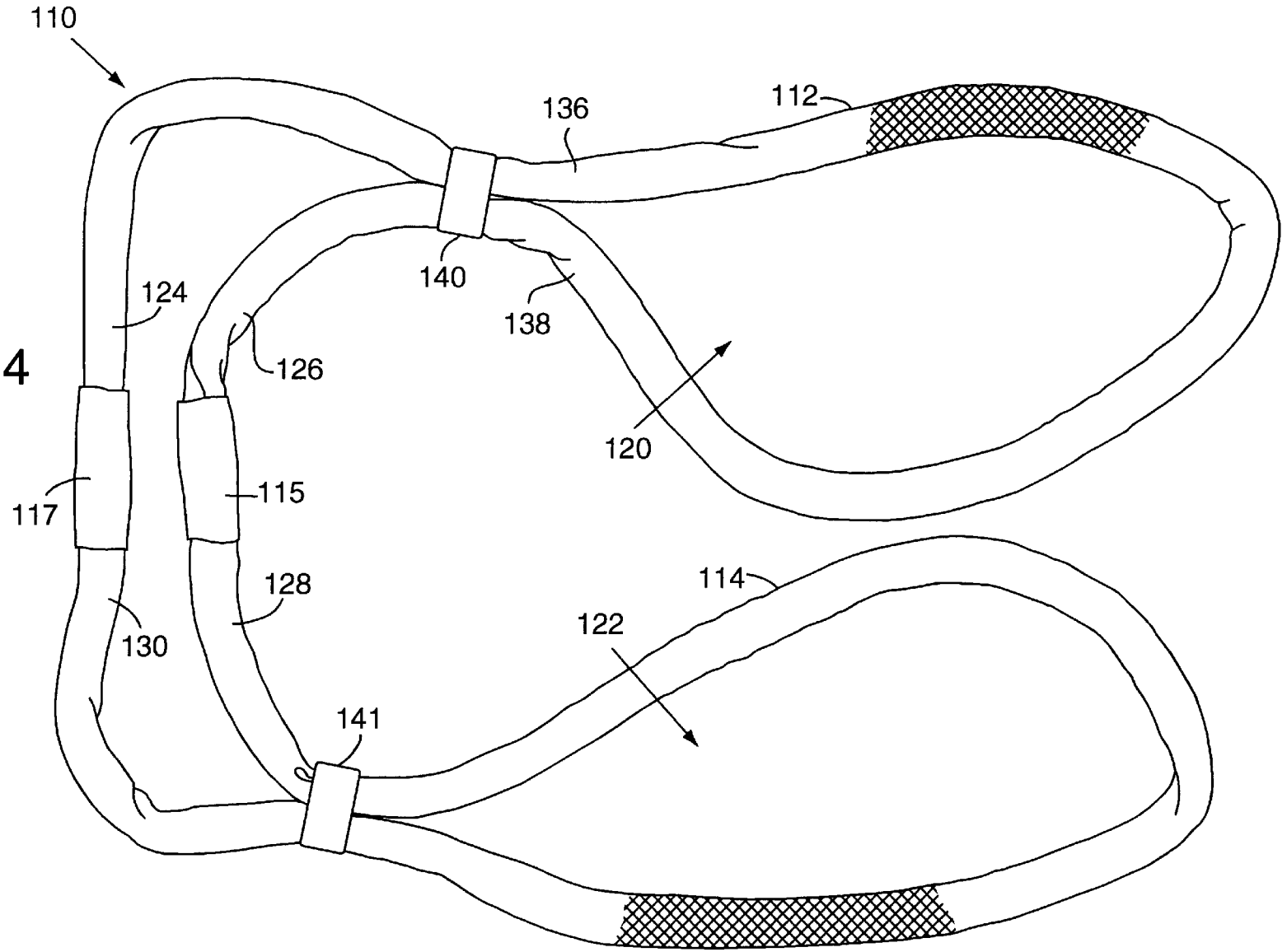
FIG. 4 is a schematic view of a second embodiment of a batter's training device in accordance with the present invention.

In FIG. 4, another embodiment of the device is indicated generally by the reference numeral 110. The device 110 is the same in many respects as the device 10 described above. Accordingly, like reference numerals preceded by the numeral 1 instead of 0 are generally used to indicate like elements. A device 110 differs from the device 10 described above in that the ends straps are joined by a pair of joining members, and the straps cooperate to define a single, larger loop.

As illustrated in FIG. 4, the device 110 includes first 112 and second 114 lengths of material, which comprise lengths of resilient, flexible material, the ends 124, 130 and 128,126, of which are coupled by joining members 117 and 115, respectively. A pair of rings are provided, and in the embodiment illustrated in FIG. 4, the rings are of similar construction to the ring 40 illustrated and described above with reference to FIG. 3. Portions of the material pass through respective rings 140,141, which cooperate with the respective lengths of material to define adjustable ankle loops 120, 122.

In operation, and with reference to FIG. 1, an appropriately sized device 10 is initially selected, based generally upon the height of the batter and the batter's shoulder width. As noted above, the preferred size permits a batter to stride during a swing such that his feet are separated by not more than a distance equal to his shoulder breadth plus about 2–6 inches. Once an appropriately sized device is selected, the user or some other person grasps and moves each adjustment ring 16,18 along the respective material 12,14 and toward the joining member 15 thereby enlarging the ankle loops 20,22. The user then steps into or otherwise puts his or her feet through respective ones of the an ankle loops 20,22. Minor adjustments to a permitted stride length may be made by tying a knot in the middle of the device.

After each loop 20,22 is positioned around a respective ankle, the rings 16,18 are moved away from the joining member 15 and along the respective material 12,14 toward the ankles so that the ankle loop is approximately the same size as the wearer's ankle, or other appropriate lower leg portion. The batter then takes a stance and performs his or her usual batting swing. In the event that the batter attempts to overstride, the device reaches a maximum length, corresponding to the predetermined maximum stride length, and the device thereby firmly yet gently prevents the batter's front foot from moving too far forward relative to the back foot. Accordingly, the device helps the batter to feel an attempt to take too long of a stride. The device 110 illustrated in FIG. 4 can be used in the same manner as the device 10.

Figure 5:
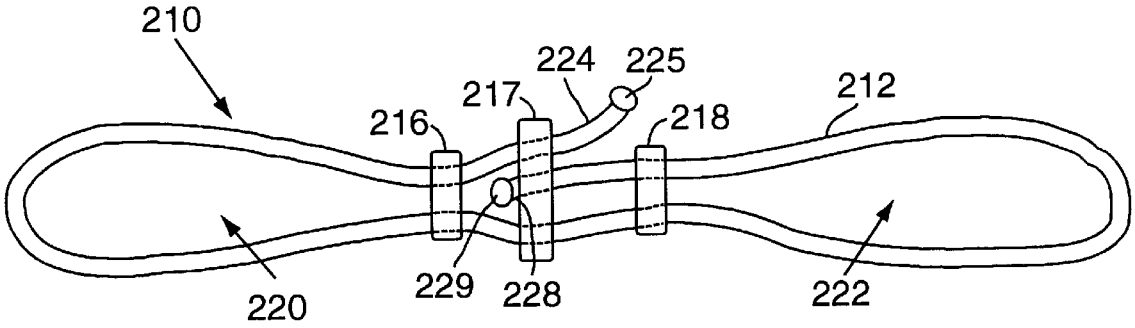
FIG. 5 is a schematic view of a third embodiment of a batter's training device in accordance with the present invention.

Turning now to FIG. 5, yet another embodiment of the device is indicated generally by the reference number 210. The device 210 is the same in many respects as the devices 10 and 110 described above. Accordingly like reference numerals proceeded by the numeral 2 instead of 0 and 1 are generally used to indicated like elements. The device 210 differs from the devices 10 and 110 described above in that the permissible stride length is adjustable.

Figure 6:
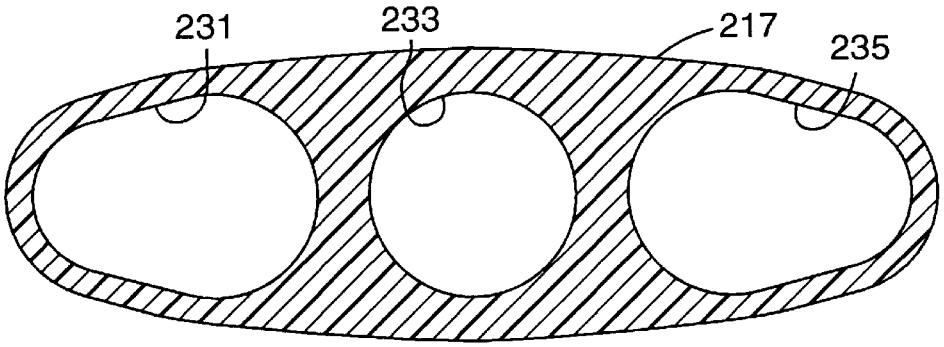
FIG. 6 is a view similar to FIGS. 2 and 3, but illustrating a third embodiment of the adjustment ring.

As illustrated in FIG. 5, the device 210 includes a single length of material 212 which comprises a length of resilient, flexible material and has ends 224 and 228 which include stops 225, 229 or other mechanism to prevent the ends of the material from passing through a ring bore, as is described further below. A pair of adjustment rings 216, 218 similar to the rings 16, 18 is provided, as is a central adjustment ring 217, which provides selective adjustment of the maximum permitted stride length. In FIG. 6, the central adjustment ring 217 includes three through bores 231,233,235. The rings 216,218 cooperate with the length of material 212 to define adjustable ankle loops in substantially the same manner as has been previously described. The length of material 212 passes through each of the rings 216,218 two times, and through the central ring 217 three times.

In operation, and with reference to FIG. 5, a batter (not shown) moves the rings 216,218 along the length of material 212 and toward the central ring 217 to enlarge the ankle loops 220,222. Then, the batter places his feet through the ankle loops, and moves the rings 216,218 towards his ankles to fit the device on his lower legs in the same manner as described above.

The maximum permitted stride length is adjusted before or after fitting the device on the batter's legs, and is adjusted by moving one or both of the rings 216,218 toward or away from the central ring 217, as appropriate, and then adjusting the material between one or both of the adjustment rings 216, 218 and the central ring 217 so that the lengths of material 212 extending between the one of the rings and the central ring are approximately equal. As noted above, the rings are maintained in position on the strap, and the friction of the length of material on one of the rings 216, 218 and the central ring 217 provides for and maintains adjustment of the maximum permitted stride length.

The above-described devices offer a number of advantages over prior art devices. Unlike prior art devices, the device firmly but gently prevents a batter from overstriding. The device of the present invention allows the batter to step laterally with respect to an oncoming ball, e.g., toward the plate for an inside pitch or away from the plate for an outside pitch, and a batter can therefore practice an appropriate swing regardless of the placement of an oncoming ball. The present invention is safer than most prior art devices since a batter may step out of the way of an oncoming ball which would otherwise hit him or her. The device is lightweight and does not generate noise during use, which might otherwise distract or prevent a batter from concentrating upon an oncoming ball. The batter only feels the device if he attempts to stride too far. In addition, the devices of the present invention are easily utilized by left handed or right handed batters.

From the foregoing, a novel device for preventing a batter from overstriding has been described in some detail. However, various modifications and substitutions may be made without departing from the spirit or the scope of the invention. Accordingly, the present invention has been described by way of example and not by way of limitation.

What is claimed is:

1. A training device worn by a batter for limiting the batter's stride to a predetermined distance during a batting swing, comprising:

at least one strip of flexible, resilient material defining a loop extending around and between a batter's lower legs, the loop defining an opening having a maximum length corresponding generally to the predetermined distance, the material also having a cross section; and a pair of adjustment rings slidably received on the at least one strip of material and cooperating with respective portions of the strip of material to form a pair of adjustable ankle loops, each of the rings defining a pair of parallel through bores having a cross section smaller than the cross section of the material and the strip of material passing through each bore of the pair of bores of a ring once so that the portion of the strip of material on a side of the ring opposite from the other ring defines the ankle loop, the rings being slidable along the material to adjust the size of each ankle loop between a first size that is large enough to receive a batter's foot therethrough and a second size that is slightly larger than a circumference of a batter's lower leg.

2. The training device as defined in claim 1, wherein the material is a woven material.

3. The training device as defined in claim 1, wherein each of the rings comprises a resilient material.

4. The training device as defined in claim 1, wherein the length of the loop defined by the strip of material also corresponds generally to the shoulder breadth of a batter.

5. The training device as defined in claim 1, wherein the at least one strip of material is two strips of material, each strip of material having a length and opposite ends; and further comprising:

means for joining each of the ends at a central position such that the two strips of material define a pair of respective loops, and wherein each ring is received on and cooperates with a respective one of the loops to define respective adjustable ankle loops for receiving therein respective ones of a batter's lower legs.

6. The training device as defined in claim 5, wherein the length of one of the strips of material is equal to the length of the other one of the strips of material.

7. A training device worn on a batter's lower legs to prevent a batter from overstriding during a batting swing, comprising:

a joining member;

a pair of strips of flexible, resilient material, each strip of material has opposite ends with the ends being permanently fastened at the joining member such that the strips of material define loops positioned respectively on opposite sides of the joining member, the material also has a cross section, the loops extend around and between a lower part of a batter's legs when worn by a batter, and when stretched during a swing each loop defines a maximum length that is approximately equal to one half of a desired stride length; and a pair of adjustment rings permanently and slidably received on respective loops of material, each of the rings defining a pair of parallel through bores smaller than the cross section of the material, each strip of material passes through each through bore of the pair of bores of a ring once so that a portion of the strip of material on a side of the ring opposite from the remaining material defines a respective ankle loop, the rings being slidable along the material to adjust the size of each ankle loop between a first size that is large enough to receive a batter's foot therethrough and a second size that is slightly larger than a circumference of a batter's lower leg.

8. The training device as defined in claim 7, wherein the length of material is a woven material.

9. The training device as defined in claim 7, wherein each of the rings comprises a resilient material.

10. The training device as defined in claim 7, wherein the combined length of the loops defined by the strips of material also corresponds to a shoulder breadth of a batter.

11. The training device as defined in claim 7, wherein the length of one of the strips of material is equal to the length of the other of the strips of material.

12. A training device worn on a batter's lower legs for preventing a batter from striding greater than a predetermined distance during a batting swing, comprising:

a strip of flexible, resilient material having a specified length and a cross section and opposite ends for extending around and between a lower part of the batter's legs when worn by a batter;

a pair of adjustment rings slidably received on the strip of material and having at least one through bore having a cross section smaller than the cross section of the strip of material, the strip of material passing though each of the rings two times so that the rings and associated portions of the strip of material cooperate to define a pair of ankle loops, the rings being slidable along the material selectively to adjust the size of each ankle loop between a first size that is large enough to receive a batter's foot therethrough and a second size that is smaller than the first size and larger than a circumference of a batter's lower leg; and a central adjustment ring slidably received on the strip of material and having at least three through bores each having a cross section smaller than the cross section of the strip, the central adjustment ring being positioned between the pair of adjustment rings and the strip of material passing though the adjustment ring three times so that the ends of the strip of material extend freely from the central adjustment member to selectively adjust the spacing between the ankle loops.

13. The training device as defined in claim 12, further comprising:

means for preventing the ends of the strip of material from passing through the bores defined in the central member while the device is worn by a batter.

14. The training device as defined in claim 12, wherein the material is a woven material.

15. The training device as defined in claim 12, wherein each of the rings defines a pair of parallel through bores, and the material passes through each bore of the at least three bores of the ring once.

16. The training device as defined in claim 12, wherein each of the rings comprises a resilient material.

17. The training device as defined in claim 12, wherein the length of the strip of material is proportional to a predetermined stride length.

* * * * *